US006325716B1

(12) United States Patent
Walker et al.

(10) Patent No.: US 6,325,716 B1
(45) **Date of Patent: *Dec. 4, 2001**

(54) CONDITIONAL LOTTERY SYSTEM

(75) Inventors: Jay S. Walker, Ridgefield; Thomas M. Sparico, Riverside, both of CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/627,192

(22) Filed: Jul. 27, 2000

Related U.S. Application Data

(63) Continuation of application No. 08/912,185, filed on Aug. 15, 1997, now Pat. No. 6,146,272.

(51) Int. Cl.[7] ..... A63F 3/06

(52) U.S. Cl. ..... 463/17; 463/29; 463/16; 273/138.1

(58) Field of Search ..... 463/1, 16–19, 463/25, 29, 40–42; 273/138.1, 269; 283/903; 379/93.13; 705/1, 14

(56) References Cited

U.S. PATENT DOCUMENTS

| | | | |
|---|---|---|---|
| 4,764,666 | 8/1988 | Bergeron | 235/380 |
| 4,882,473 | 11/1989 | Bergeron | 235/380 |
| 4,922,522 | 5/1990 | Scanlon | 379/95 |
| 4,937,853 | 6/1990 | Brule et al. | 379/96 |
| 5,082,275 | 1/1992 | Nilssen | 273/138 A |

(List continued on next page.)

FOREIGN PATENT DOCUMENTS

| | | |
|---|---|---|
| 0 307 925 A2 | 3/1989 | (EP) . |
| 0 307 925 B1 | 3/1989 | (EP) . |
| 0 620 688 A2 | 10/1994 | (EP) . |

OTHER PUBLICATIONS

"Michigan Lotto Creates Another Millionaire"; Section Regional News; Distribution: Michigan; Sep. 16, 1984.

Schapiro, Jeff E., "Virginia Lottery"; The Richmond Times Dispatch; Section: Discover Richmond; p. S–89; Aug. 4, 1996.

Larkin, Leah; "Playing The Lottery Card"; International Gaming and Wagering Business; Section: p. 34; ISSN: 8750–8222; Dec. 1996.

*Primary Examiner*—Joe H. Cheng
*Assistant Examiner*—John M. Hotaling, II
(74) *Attorney, Agent, or Firm*—Dean P. Alderucci

(57) ABSTRACT

A conditional lottery ticket system is disclosed to process conditional lottery ticket transactions, including the acceptance and validation of play entries. The conditional lottery ticket system preferably includes a central lottery server and one or more remote lottery terminals. The conditional lottery ticket system permits a player to purchase conditional lottery tickets that are not activated until one or more player-defined activation conditions are satisfied. The player-defined activation conditions may include a minimum lottery jackpot, a particular future date of activation, or the occurrence of a particular external event. Conditional lottery tickets may be purchased (i) individually and activated the next time the player-specified activation conditions are satisfied; (ii) on a subscription basis for a predefined number of times when the player-specified activation conditions are satisfied; or (iii) on a perpetual subscription basis, until the subscription is cancelled. The conditional lottery ticket system permits the player to specify the numbers to be played for each game, as well as any activation conditions. After the selected lottery numbers and any activation conditions have been stored, the lottery terminal preferably prints and issues the official lottery ticket, indicating the lottery numbers to be played, as well as any specified activation conditions. The conditional lottery ticket system preferably evaluates pending conditional lottery tickets to determine if the player-defined activation conditions of any conditional lottery tickets are satisfied on a periodic basis, or at some predefined time period before each lottery drawing.

28 Claims, 13 Drawing Sheets

U.S. PATENT DOCUMENTS

| | | | |
|---|---|---|---|
| 5,112,050 | 5/1992 | Koza et al. | 273/139 |
| 5,119,295 | 6/1992 | Kapur | 364/412 |
| 5,158,293 | 10/1992 | Mullins | 273/139 |
| 5,223,698 | 6/1993 | Kapur | 235/375 |
| 5,232,221 | 8/1993 | Sludikoff et al. | 273/139 |
| 5,327,485 | 7/1994 | Leaden | 379/95 |
| 5,330,185 | 7/1994 | Wells | 273/138 A |
| 5,354,069 | 10/1994 | Guttman et al. | 273/439 |
| 5,398,932 | 3/1995 | Eberhardt et al. | 273/138 A |
| 5,403,999 | 4/1995 | Entenmann et al. | 235/379 |
| 5,613,680 | 3/1997 | Groves et al. | 273/138.2 |
| 5,713,795 | 2/1998 | Kohorn | 463/17 |
| 5,722,890 | 3/1998 | Libby et al. | 463/17 |
| 5,791,990 | 8/1998 | Schroeder et al. | 463/17 |
| 5,871,398 | 2/1999 | Schneier et al. | 463/16 |
| 5,910,047 | 6/1999 | Scagnelli et al. | 463/17 |
| 5,917,893 | 6/1999 | Katz | 379/93.02 |

500

| | TICKET NUMBER 525 | GAME TYPE 530 | NUMBERS SELECTED 535 | PURCHASE DATE 540 | DRAWING DATE 545 | MERCHANT ID# 550 |
|---|---|---|---|---|---|---|
| 505 | 45677 | PICK 6 | 1,4,10,19,31,42 | 6/21/97 | 6/23/97 | 42 |
| 510 | 45679 | PICK 6 | 2,5,11,20,32,43 | 6/21/97 | 6/23/97 | 42 |
| 515 | 45680 | PICK 6 | 3,6,12,21,33,40 | 6/21/97 | 6/23/97 | 43 |
| 520 | 45682 | PICK 6 | 4,7,13,22,34,39 | 6/21/97 | 6/23/97 | 43 |

FIG. 5

600

| | TICKET NUMBER 625 | GAME TYPE 630 | NUMBERS SELECTED 635 | PURCHASE DATE 640 | MERCHANT ID# 645 | ACTIVATION CONDITIONS 650 | STATUS 655 |
|---|---|---|---|---|---|---|---|
| 605 | 45678 | PICK 6 | 5,7,20,23,31,36 | 6/21/97 | 42 | JACKPOT OVER $20m | INACTIVE |
| 610 | 45681 | PICK 6 | 9,13,22,29,32,38 | 6/21/97 | 43 | DRAWING DATE =6/30/97 | INACTIVE |
| 615 | 45683 | PICK 6 | 13,16,19,20,28,30 | 6/21/97 | 43 | JACKPOT OVER $5m | ACTIVE |

FIG. 6

700

| | TICKET NUMBER 725 | GAME TYPE 730 | DRAWING DATE 735 | PRIZE 740 |
|---|---|---|---|---|
| 705 | 34567 | PICK 6 | 6/19/97 | $3,000,000.00 |
| 710 | 38679 | PICK 6 | 6/19/97 | $1,000,000.00 |
| 715 | 45683 | PICK 6 | 6/23/97 | $2.00 |

FIG. 7

CONDITIONAL LOTTERY SYSTEM

CROSS-REFERENCE TO RELATED CORRESPONDING APPLICATIONS

This is a continuation of commonly owned, U.S. patent application Ser. No. 08/912,185 entitled "CONDITIONAL LOTTERY SYSTEM" filed Aug. 15, 1997, issued on Nov. 14, 2000 as U.S. Pat. No. 6,146,272, all of which is incorporated in its entirety by reference herein.

FIELD OF THE INVENTION

The present invention relates generally to a system for processing lottery ticket transactions, and more particularly, to a system for processing lottery tickets which are not activated until one or more customer-defined activation conditions, such as a predefined minimum lottery jackpot, are satisfied.

BACKGROUND OF THE INVENTION

Many government and private entities conduct lotteries. Government-conducted lotteries offer players the chance to win a large prize, and have the added benefit of increasing governmental revenues without burdening the public with additional taxes. In many instances, the revenue generated from a governmental lottery is dedicated, at least in part, to a particular purpose or goal, such as improving the education system or reducing property taxes.

Typically, government-conducted lottery systems utilize a central lottery computer to communicate with remote dedicated lottery terminals. A player typically selects numbers on a lottery "sense mark slip", and the lottery terminal operator inserts the sense mark slip into a reader at the lottery terminal, which optically reads the sense mark slip using a known mark sensing process. Alternatively, most lottery systems offer automatic lottery number generation features, commonly referred to as "quick-pick" systems, which randomly select lottery numbers on behalf of the player. The dedicated lottery terminal then communicates the player's selected numbers to the central lottery computer for validation and storage. After the lottery numbers have been stored, the dedicated lottery terminal, under the direction of the central lottery computer, prints and issues the official lottery ticket.

One popular lottery game, commonly referred to as "lotto", typically requires the player to choose six numbers between one and forty-two. The selected group of numbers are then compared to the winning lottery numbers, which have been randomly selected from the larger pool of numbers, between one and forty-two, at some specified time and date after purchase of the lotto ticket. To win a prize, the player-selected lotto ticket numbers must match all or some of the winning lottery numbers.

Lotto drawings are typically conducted on a periodic basis, with many state lotteries conducting "lotto" drawings as often as twice per week. Previously, players were required to appear in person at a dedicated lottery terminal to purchase their lottery tickets for each lottery drawing. In order to increase ticket sales, as well as customer-convenience, many lottery systems now offer subscription sales of lottery tickets, which automatically enter a player in the lottery game for a predefined number of weeks, often at a discounted price.

If the jackpot prize is not awarded for a particular lotto drawing, the jackpot prize value typically rolls over to increase the jackpot for the subsequent drawing. Thus, jackpots increase from week to week as no one wins. The amount of the jackpot prize is typically determined based on a sales trend from the prior year. It has been found that many people only buy lottery tickets when the jackpot exceeds a certain amount. Thus, as the jackpot prize gets larger, there is a dramatic increase in the number of tickets sold. Occasionally, when jackpots have risen to particularly large amounts, some lottery systems have not had sufficient capacity to meet the increased ticket demand.

Thus, during times of peak demand, players are met with longer lines at lottery terminals, and generally find it more frustrating to obtain a lottery ticket. Rather than providing an environment that encourages such infrequent players to become regular players, the difficulty associated with obtaining a lottery ticket for a large jackpot often discourages players from returning. While the subscription sale of lottery tickets allows regular players to enroll in all drawings for a predefined period, and thereby avoid a time-consuming trip to the lottery terminal when the jackpot increases, conventional lottery subscription sale systems do not provide a solution for infrequent players who only want to enroll in drawings associated with larger jackpot prizes.

As apparent from the above-described deficiencies with conventional systems for processing lottery ticket transactions, a need exists for a lottery ticket sale system that allows a player to buy lottery tickets in advance and specify the conditions, such as a desired minimum jackpot amount, at which the player would like the lottery ticket to become active. A further need exists for a system that increases ticket sales, as well as player convenience, particularly at times of peak demand. Yet another need exists for a lottery system that enables conditional lottery play.

SUMMARY OF THE INVENTION

Generally, according to one aspect of the invention, a conditional lottery ticket system processes conditional lottery ticket transactions, including the acceptance and validation of play entries. The conditional lottery ticket system preferably includes a central lottery server and one or more remote lottery terminals. The conditional lottery ticket system permits a player to purchase conditional lottery tickets that are not activated until one or more player-defined activation conditions are satisfied. The player-defined activation conditions may include, for example, a minimum lottery jackpot, a particular future date of activation, or a particular external event, such as when the moon on the drawing date will be a full moon. The player may be permitted to play a conditional lottery ticket at no additional charge over the normal cost of a conventional lottery ticket, as an incentive for increased play, or upon payment of an additional fee, as a premium charged to the player for the convenience offered by the conditional lottery ticket.

The conditional lottery ticket system preferably permits a player to purchase conditional lottery tickets (i) individually, whereby the player's lottery ticket is activated the next time the player-specified activation conditions are satisfied; (ii) on a subscription basis for a predefined fee, whereby the player's lottery ticket is automatically activated a predefined number of times when the player-specified activation conditions are satisfied; or (iii) on a perpetual subscription basis, whereby the player's lottery ticket is automatically activated each time the player-specified activation conditions are satisfied until the subscription is cancelled.

According to a further aspect of the invention, the conditional lottery ticket system permits the player to specify the numbers to be played for each game, as well as any activation conditions. In one embodiment, a player utilizes a sense mark strip or another suitable computer-readable material, to indicate the numbers to be played and any activation conditions. Alternatively, the conditional lottery ticket system may incorporate a "quick-pick" lottery number generation feature, which randomly selects lottery numbers on behalf of the player, either at the time of sale or at the time the ticket is activated.

The lottery terminal reads the sense mark slip and the player's selected numbers and any specified activation conditions are then communicated to the central lottery server for validation and storage. After the selected lottery numbers and any activation conditions have been stored, the lottery terminal, under the direction of the central lottery server, preferably prints and issues the official lottery ticket, indicating the lottery numbers to be played, as well as any specified activation conditions. The conditional lottery ticket system preferably evaluates the pending conditional lottery tickets to determine if the player-defined activation conditions of any conditional lottery tickets are satisfied on a periodic basis, or at some predefined time period before each lottery drawing.

Another aspect of the invention allows a player to specify one or more side bets, for example, on the number of jackpot winners, or on particular characteristics of the jackpot winners, such as the sex, county, or age of the jackpot winner, preferably for an additional amount over the normal cost of a lottery ticket. Prizes for the side bet can be separately awarded or awarded as a multiplier of conventional lottery jackpot awards.

A more complete understanding of the present invention, as well as further features and advantages of the present invention, will be obtained by reference to the following detailed description and drawings.

BRIEF DESCRIPTION OF THE DRAWINGS

FIG. 5 illustrates a sample table from the ticket database of FIG. 4;

FIG. 6 illustrates a sample table from the conditional ticket database of FIG. 4;

FIG. 7 illustrates a sample table from the winning ticket database of FIG. 4;

DETAILED DESCRIPTION

Figure 1:
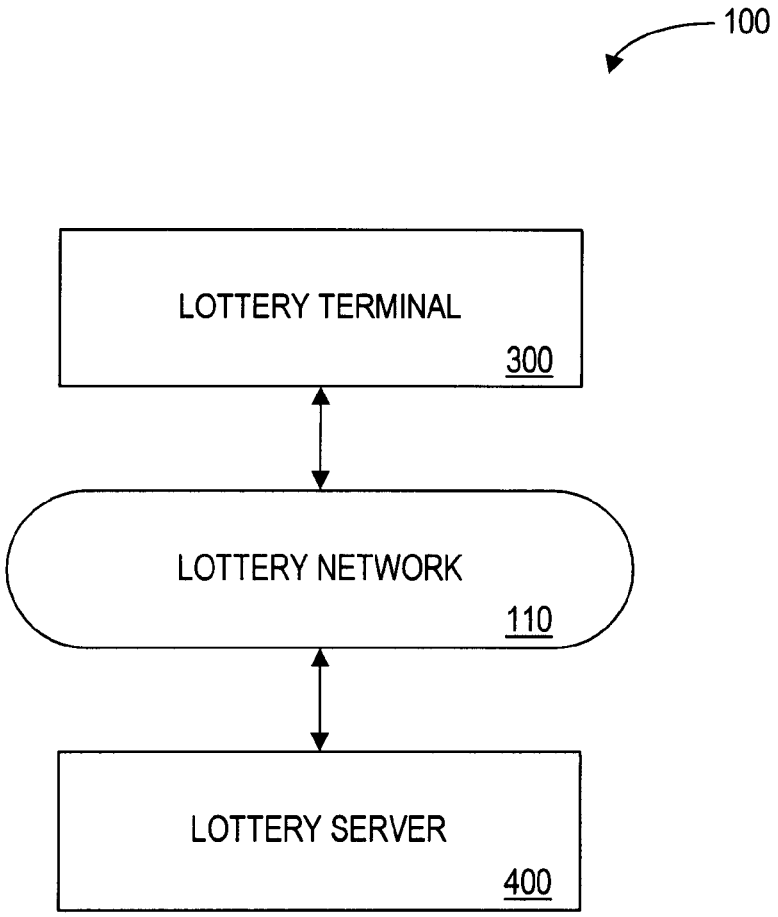
FIG. 1 is a schematic block diagram illustrating a conditional lottery system in accordance with one embodiment of the present invention.

FIG. 1 shows a conditional lottery ticket system 100 for processing conditional lottery ticket transactions, including the acceptance and validation of play entries, for example, in a state lottery. The conditional lottery ticket system 100 includes a lottery network 110 for transferring information between a central lottery server 400, discussed below in conjunction with FIG. 4, and one or more remote lottery terminals, such as an illustrative lottery terminal 300, discussed below in conjunction with FIG. 3.

According to a feature of the present invention, the conditional lottery ticket system 100 permits a player to purchase conditional lottery tickets that are not activated until one or more player-defined activation conditions are satisfied. For example, a player can specify that a particular lottery ticket should not be activated until the lottery jackpot exceeds a predefined threshold. In addition, a player can specify that a particular lottery ticket should not be activated until a particular date or until the occurrence of some external event, such as when the drawing date will fall on a "Friday the thirteenth." The player may be allowed to specify one or more player-defined conditions (a) at no additional charge over the normal cost of a conventional lottery ticket, as an incentive for increased play, or (b) upon payment of an additional fee, as a premium charged to the player for the convenience offered by the conditional lottery ticket.

According to a further feature of the invention, the conditional lottery ticket system 100 preferably permits a player to purchase conditional lottery tickets (i) individually, whereby the player's lottery ticket is activated the next time the player-specified activation conditions are satisfied; (ii) on a subscription basis for a predefined fee, whereby the player's lottery ticket is automatically activated a predefined number of times when the player-specified activation conditions are satisfied; or (iii) on a perpetual subscription basis, whereby the player's lottery ticket is automatically activated each time the player-specified activation conditions are satisfied until the subscription is cancelled, for example, by charging the cost of activated tickets to a debit card or a credit card. As with conventional lottery systems, the conditional lottery ticket system 100 may optionally include a mechanism for automatically notifying subscription players of prize winnings.

The lottery terminal 300 and the central lottery server 400, discussed further below in conjunction with FIGS. 3 and 4, respectively, may comprise conventional hardware and software, as modified herein to carry out the functions and operations described below. The lottery terminal 300 and the central lottery server 400 transmit digitally encoded data and other information between one another over the lottery network 110. The lottery network 110 preferably comprises cable or wireless links on which electronic signals can propagate, and may be embodied, for example, as (i) a dedicated wide area network (WAN), (ii) a telephone network, including the combination of local and long distance wire or wireless facilities and switches known as the public switched telephone network ("PSTN"), or (iii) the Internet. The data and other information transmitted by the lottery terminal 300 to the central lottery server 400 for validation and storage may represent a player's name or identification number, numbers to be played, and any activation conditions. Likewise, the data and other information transmitted by the central lottery server 400 to the lottery terminal 300 may represent play results and an acknowledgement or validation of play information for printing of an official lottery ticket by the lottery terminal 300.

Figure 2A:
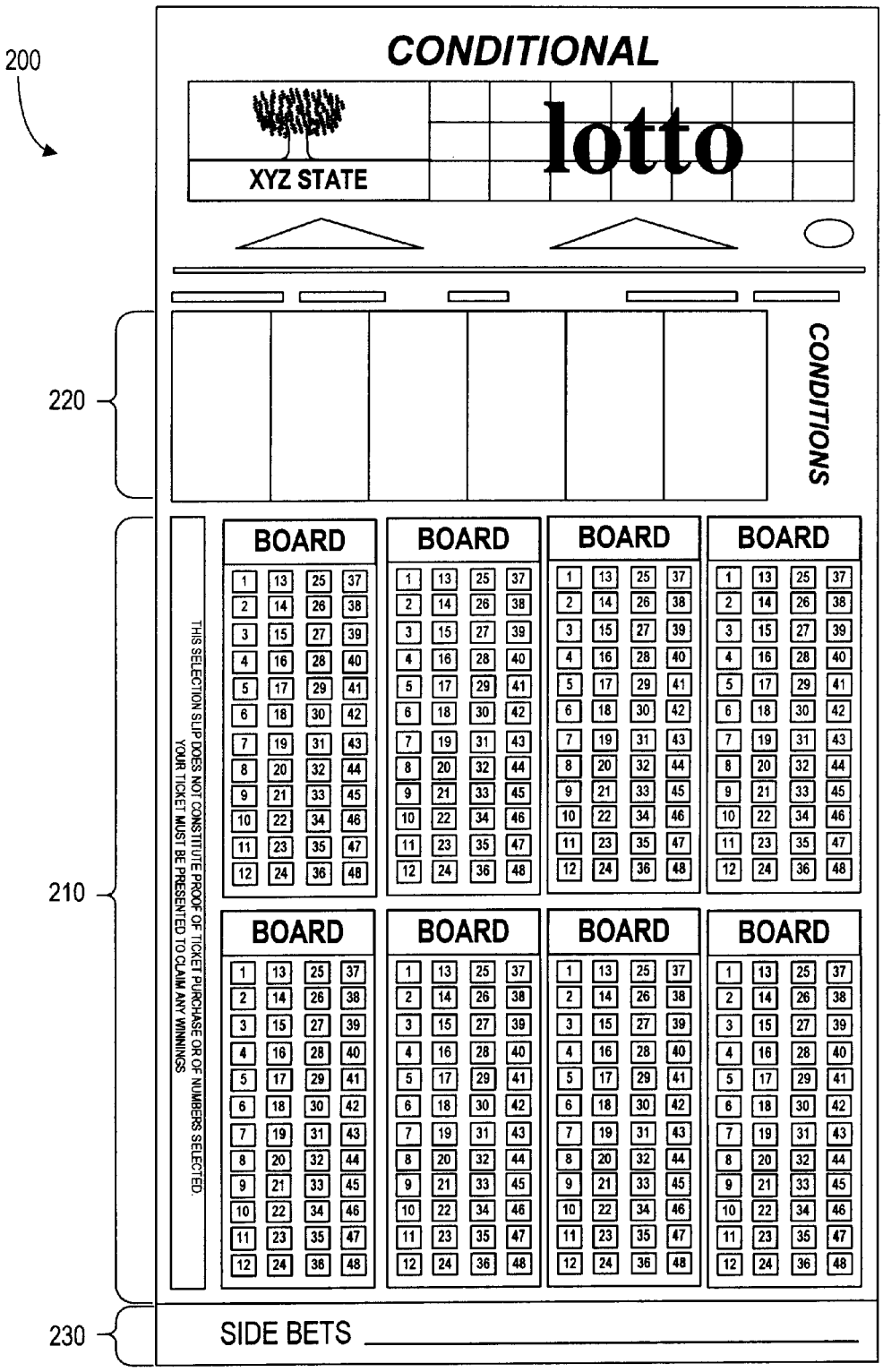
FIG. 2*a* is an example of an illustrative sense mark slip in accordance with an embodiment of the present invention.

According to a feature of the present invention, the conditional lottery ticket system 100 permits the player to specify the numbers to be played for each game, as well as any activation conditions. In one embodiment, shown in FIG. 2*a*, a player utilizes a sense mark strip 200 or another suitable computer-readable material, to indicate (i) the numbers to be played in a number selection region 210 and (ii) any activation conditions in a condition specification region 220. Alternatively, the conditional lottery ticket system 100 may incorporate an automatic lottery number generation feature, commonly referred to as a "quick-pick" system, which randomly selects lottery numbers on behalf of the player. The "quick-pick" numbers may be generated by the conditional lottery ticket system 100 at the time of sale or at the time the ticket is activated. In such a "quick-pick" embodiment, the activation conditions can nonetheless be specified by the player orally to the operator of the lottery terminal 300 or using a modified sense mark strip 200 or another suitable computer-readable medium.

In an alternate or supplemental embodiment, a player can specify one or more side bets in a region 230 of the sense mark strip 200. Thus, according to a further feature of the invention, the conditional lottery ticket system 100 permits a player to place additional bets, for example, on the number of jackpot winners, or on particular characteristics of the jackpot winners, such as the sex, county, or age of the jackpot winner, preferably for an additional amount over the normal cost of a lottery ticket. Prizes for the side bet can be separately awarded or awarded as a multiplier of conventional lottery jackpot awards, as would be apparent to a person of ordinary skill.

Figure 2B:
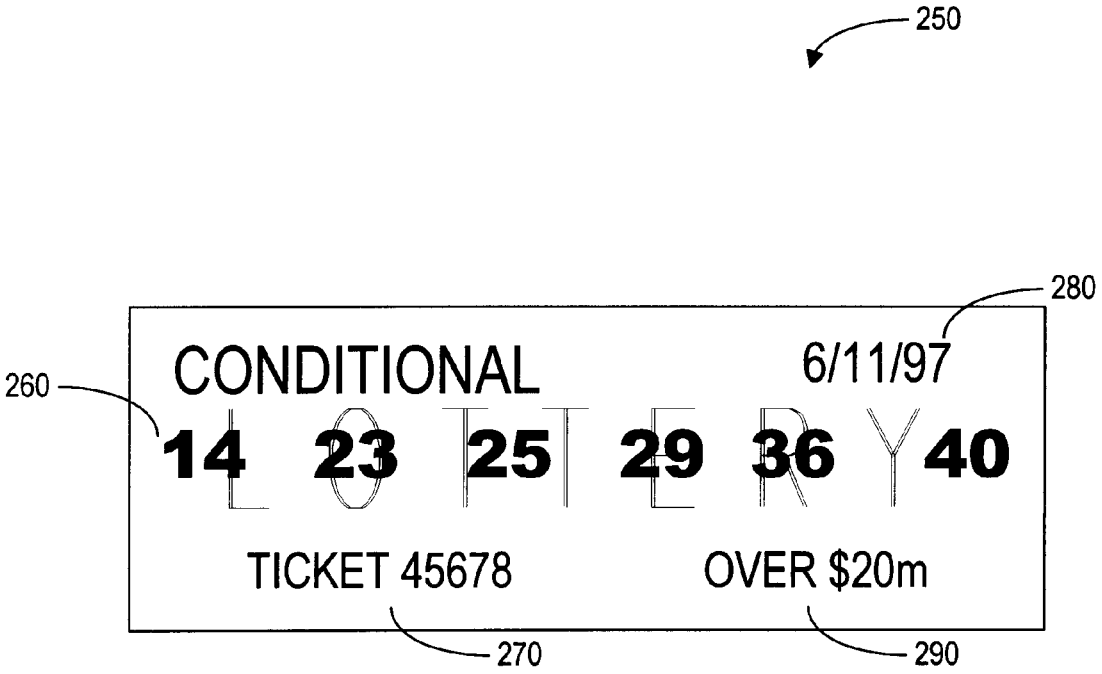
FIG. 2*b* is an example of an illustrative lottery ticket in accordance with an embodiment of the present invention.

Once the central lottery server 400 has validated and stored the player's numbers and any activation conditions, in a manner discussed further below, the lottery terminal 300 preferably issues a lottery ticket 250, shown in FIG. 2*b*, to the player indicating the lottery numbers to be played in a field 260, as well as a ticket identification number 270, the date of issuance 280 and any specified activation conditions 290.

Figure 3:
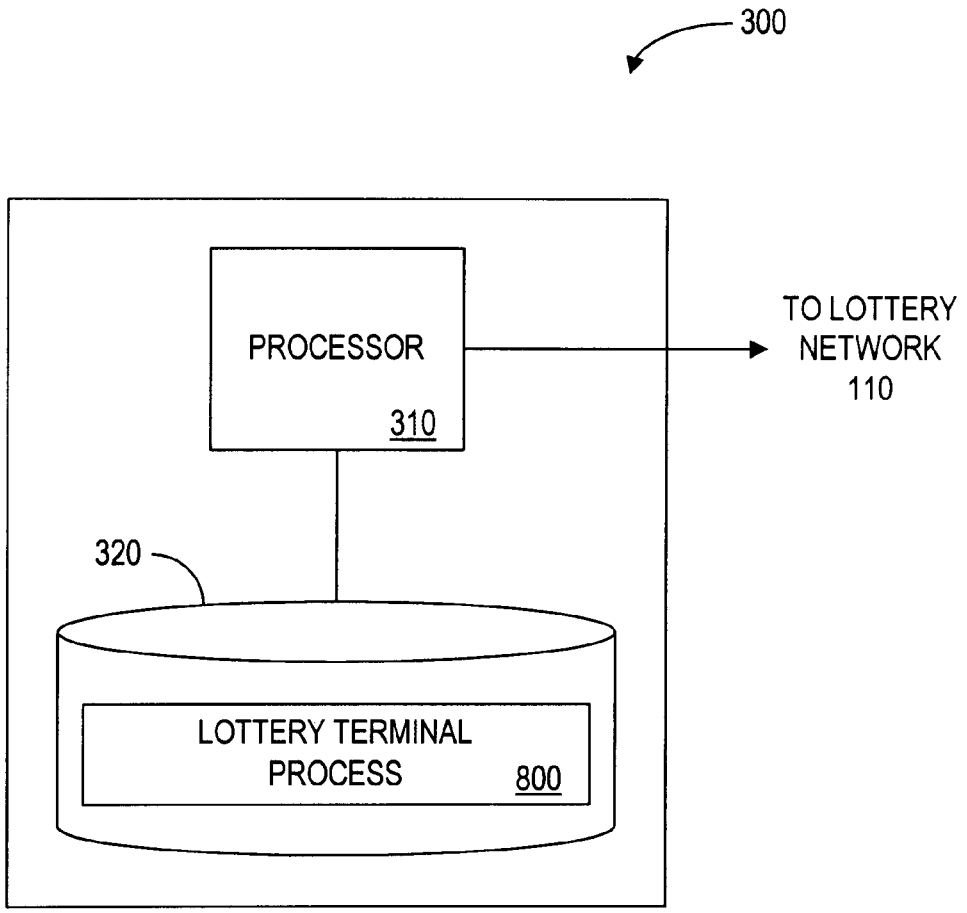
FIG. 3 is a schematic block diagram of an exemplary lottery terminal of FIG. 1.

FIG. 3 is a block diagram showing the architecture of an illustrative lottery terminal 300. The lottery terminal 300 may be embodied, for example, as a conventional dedicated lottery terminal, as modified herein to execute the functions and operations of the present invention. Alternatively, the lottery terminal 300 may be embodied as a point-of-sale terminal that generates sales receipts containing both merchandise sales information and conditional lottery ticket information, as disclosed in copending U.S. patent application Ser. No. 08/822,709, filed Mar. 20, 1997, assigned to the assignee of the present invention and incorporated by reference herein.

The lottery terminal 300 preferably includes a processor 310 and related memory, such as a data storage device 320. The processor 310 may be embodied as a single processor, or a number of processors operating in parallel. The data storage device 320 and/or a read only memory (ROM) are operable to store one or more instructions, which the processor 310 is operable to retrieve, interpret and execute. The processor 310 preferably includes a control unit, an arithmetic logic unit (ALU), and a local memory storage device, such as, for example, an instruction cache or a plurality of registers, in a known manner. The control unit is operable to retrieve instructions from the data storage device 320 or ROM. The ALU is operable to perform a plurality of operations needed to carry out instructions. The local memory storage device is operable to provide high-speed storage used for storing temporary results and control information.

As discussed further below in conjunction with FIG. 8, the data storage device 320 preferably includes a lottery terminal process 800. Generally, the lottery terminal process 800 receives play information from a player, for example, by reading a sense mark strip 200, and communicates with the central lottery server 400 via the lottery network 110 to validate and store the play information and thereafter issue a lottery ticket 250 to the player.

Figure 4:
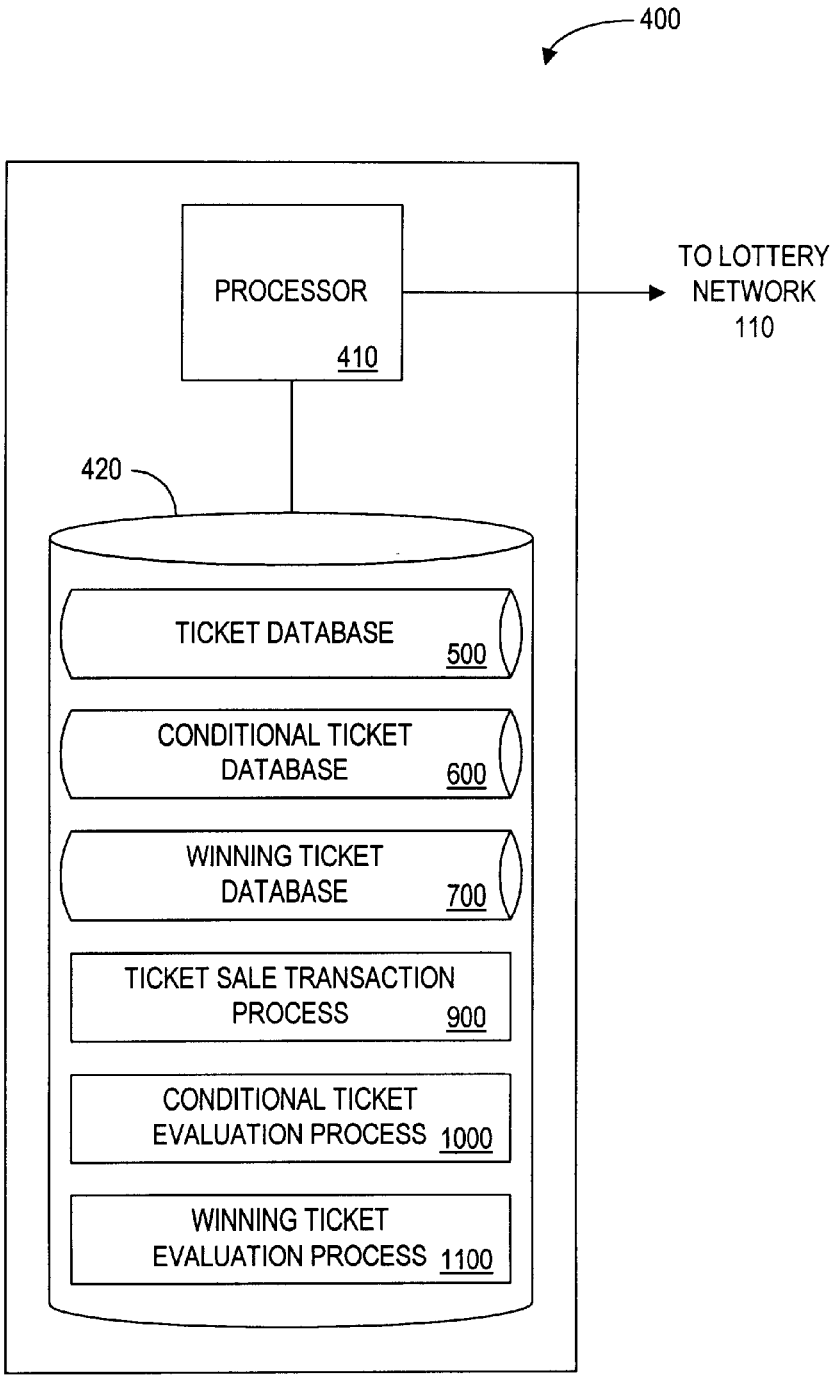
FIG. 4 is a schematic block diagram of an exemplary lottery server of FIG. 1.

FIG. 4 is a block diagram showing the architecture of an illustrative central lottery server 400. The central lottery server 400 may be embodied, for example, as an RS 6000 server, manufactured by IBM Corp., as modified herein to execute the functions and operations of the present invention. The central lottery server 400 preferably includes a processor 410 and related memory, such as a data storage device 420, which operate in a similar manner to the hardware described above in conjunction with FIG. 3.

The processor 410 preferably incorporates a random number generation function and a cryptographic processing function. The random number generation function is utilized to generate random "quick-pick" lottery numbers, in the manner described above. The cryptographic processing function is utilized to encrypt an authentication code that may be associated with a particular lottery transaction.

As discussed further below in conjunction with FIGS. 5 through 7, respectively, the data storage device 420 preferably includes a ticket database 500, a conditional ticket database 600 and a winning ticket database 700. The ticket database 500 preferably stores information on each ticket that is currently active in the conditional lottery ticket system 100. The conditional ticket database 600 preferably stores information on each conditional lottery ticket which is pending in the conditional lottery ticket system 100, including an indication of associated activation conditions. The winning ticket database 700 preferably stores information on each ticket which has won a prize from the conditional lottery ticket system 100, including an indication of the prize amount.

In addition, as discussed further below in conjunction with FIGS. 9 through 11, the data storage device 420 preferably also includes a ticket sale transaction process 900, a conditional ticket evaluation process 1000 and a winning ticket evaluation process 1100. Generally, the ticket sale transaction process 900, shown in FIGS. 9*a* and 9*b*, coordinates lottery ticket transactions, such as the acceptance, validation and storage of play entries, including the player's numbers and any activation conditions. The conditional ticket evaluation process 1000, shown in FIG. 10, preferably periodically evaluates pending conditional lottery tickets to determine if the associated player-specified activation conditions are satisfied and thereby activate the conditional ticket. The winning ticket evaluation process 1100, shown in FIG. 11, preferably compares the numbers associated with each activated lottery ticket for a given drawing with winning number combinations to identify winning tickets and associated prize amounts.

FIG. 5 illustrates an exemplary ticket database 500 that preferably stores information on each ticket which is currently active in the conditional lottery ticket system 100. The ticket database 500 maintains a plurality of records, such as records 505–520, each associated with a different active ticket. For each active ticket identified by ticket number in field 525, the ticket database 500 includes an indication of the game type and numbers selected in fields 530 and 535. In addition, the ticket database 500 preferably records the ticket purchase date, drawing date and merchant identifier in fields 540 through 550, respectively.

FIG. 6 illustrates an exemplary conditional ticket database 600 that preferably stores information on each conditional lottery ticket which is pending in the conditional lottery ticket system 100, including an indication of associated activation conditions. The conditional ticket database 600 maintains a plurality of records, such as records 605–615, each associated with a different conditional lottery ticket. For each conditional lottery ticket identified by ticket number in field 625, the conditional ticket database 600 includes an indication of the game type and numbers selected in fields 630 and 635. In addition, the conditional ticket database 600 preferably records the ticket purchase date and merchant identifier in fields 640 and 645, respectively. Finally, the conditional ticket database 600 records the associated activation conditions and current status in fields 650 and 655, respectively.

FIG. 7 illustrates an exemplary winning ticket database 700 that preferably stores information on each ticket that has won a prize from the conditional lottery ticket system 100, including an indication of the prize amount. The winning ticket database 700 maintains a plurality of records, such as records 705–715, each associated with a different winning ticket. For each winning ticket identified by ticket number in field 725, the winning ticket database 700 includes an indication of the game type, drawing date and corresponding prize amount in fields 730 through 740, respectively.

Figure 8:
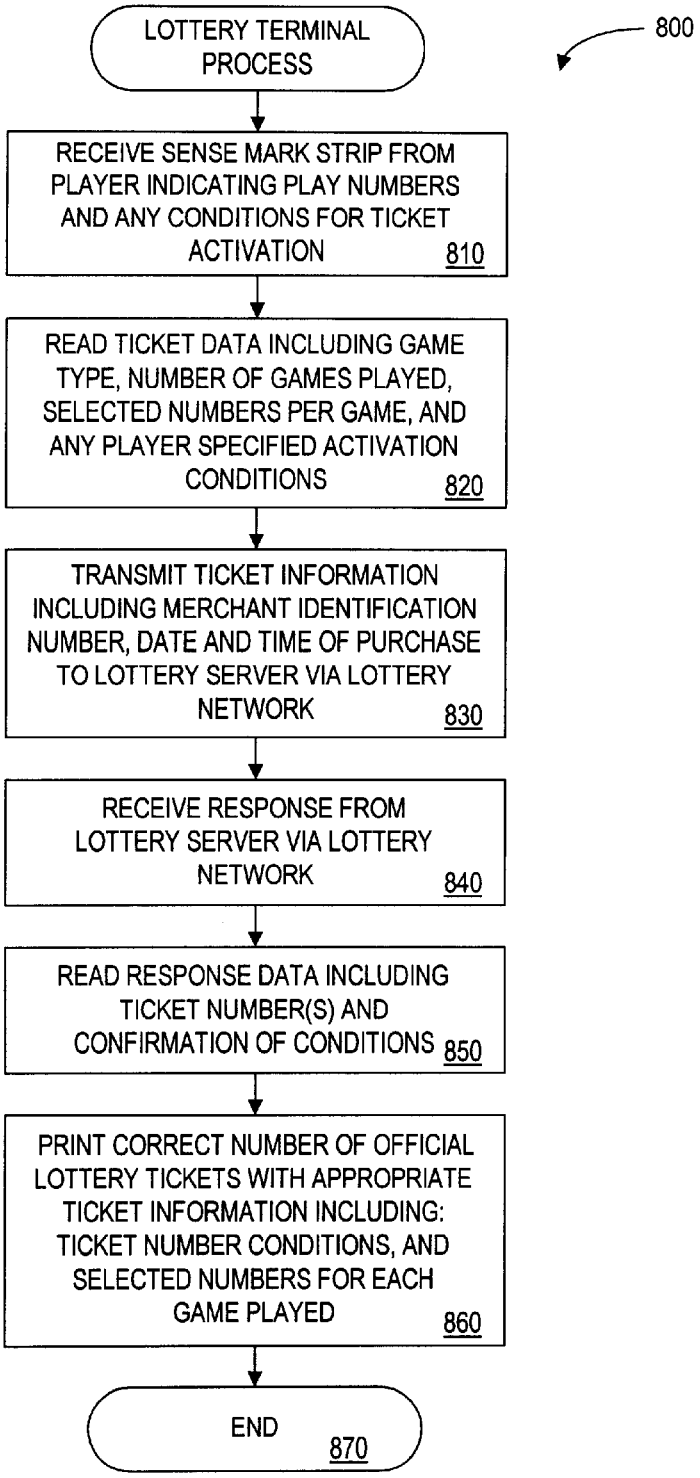
FIG. 8 is a flow chart describing an exemplary lottery terminal process as implemented by the lottery terminal of FIG. 3.

As discussed above, the lottery terminal 300 preferably executes a lottery terminal process 800, shown in FIG. 8, to receive play information from a player, for example, by reading a sense mark strip 200, and to communicate with the central lottery server 400 via the lottery network 110 to validate and store the play information and thereafter issue a lottery ticket 250 to the player. As illustrated in FIG. 8, the lottery terminal process 800 begins the processes embodying the principles of the present invention during step 810, upon receipt of a sense mark strip 200 from a player indicating play number or any conditions for ticket activation. It is noted that in a "quick-pick" implementation, the play numbers will preferably be randomly generated by the processor 410 of the central lottery server 400.

The lottery terminal 300 will then read the ticket data from the sense mark strip 200, during step 820, including the game type, number of games played, selected numbers per game, and any player-specified activation conditions. Thereafter, the ticket information obtained in the previous step is preferably transmitted to the central lottery server 400 during step 830, together with a merchant identifier, and time and date of purchase.

The lottery terminal 300 will wait for a response from the central lottery server 400 during step 840 and thereafter read the received response during step 850, including the ticket number which has been assigned by the central lottery server 400 and a confirmation of the activation conditions.

Finally, the lottery terminal 300 will print the correct number of official lottery tickets during step 860 with the appropriate ticket information, preferably including the assigned ticket number, activation conditions and selected numbers for each game played, before program control terminates during step 870.

Figure 9A:
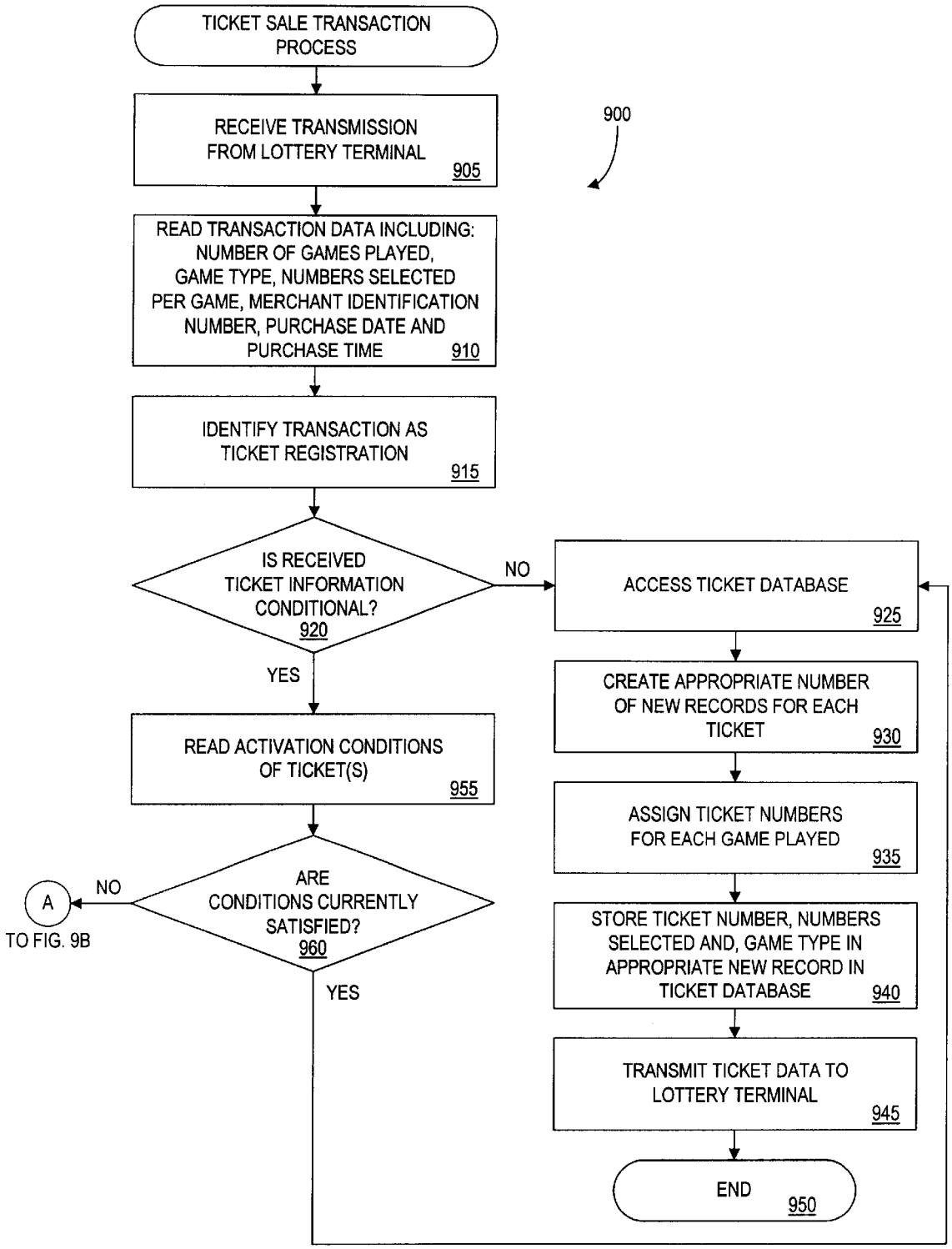
FIGS. 9*a* and 9*b*, collectively, are a flow chart describing an exemplary ticket sale transaction process as implemented by the lottery server of FIG. 4.
Figure 9B:
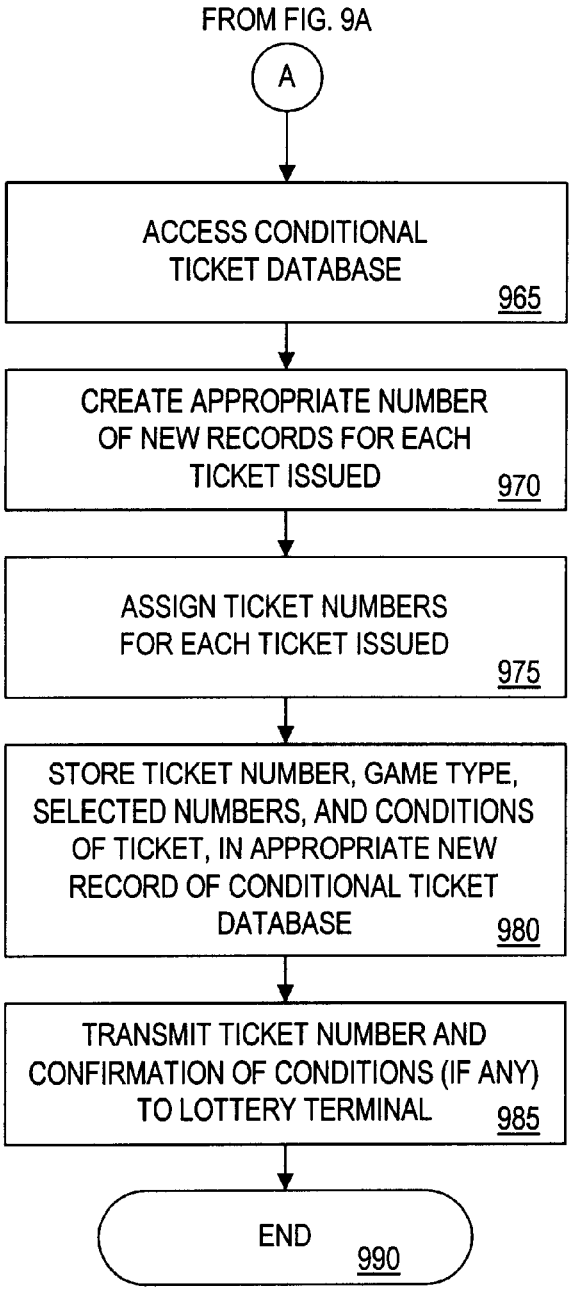

As discussed above, the central lottery server 400 preferably executes a ticket sale transaction process 900, shown in FIGS. 9*a* and 9*b*, to coordinate lottery ticket transactions, such as the acceptance, validation and storage of play entries, including the player's numbers and any activation conditions. As illustrated in FIG. 9*a*, the ticket sale transaction process 900 begins the processes embodying the principles of the present invention during step 905, upon receipt of a transmission from a lottery terminal 300. Thereafter, the central lottery server 400 will read the transaction data during step 910, including the number of games played, game type, numbers selected per game played, merchant identifier, and purchase time and date.

The ticket sale transaction process 900 will then identify the transaction as a ticket registration during step 915. A test is then performed during step 920 to determine if the received ticket information is conditional. If it is determined during step 920 that the received ticket information is not conditional, then the ticket sale transaction process 900 will access the ticket database 500 during step 925 and then create an appropriate number of new records in the ticket database 500 for each active ticket during step 930. Thereafter, ticket numbers are assigned during step 935 for each game played, before the ticket number, numbers selected and game type are stored in the appropriate new record in the ticket database 500 during step 940. The ticket data is then transmitted to the lottery terminal 300 during step 945 before program control ends during step 950.

If, however, it is determined during step 920 that the received ticket information is conditional, then the activation conditions of the tickets are read during step 955 and a test is then performed during step 960 to determine if the conditions are currently satisfied. If it is determined during step 960 that the conditions are currently satisfied, then program control proceeds to step 925 to activate the tickets and create ticket records in the ticket database 500, in the manner described above. For example, if the amount of the jackpot prize already exceeds five million dollars ($5,000,000) at the time ticket number 45683 (FIG. 6) is sold, then the ticket is automatically activated at the time of the sale, and a ticket record is automatically created in the active ticket database 500.

If, however, it is determined during step 960 that the conditions are not currently satisfied, then program control proceeds to step 965 (FIG. 9*b*) to store the play information in the conditional ticket database 600. Thus, the ticket sale transaction process 900 will access the conditional ticket database 600 during step 965 and then create an appropriate number of new records in the conditional ticket database 600 for each conditional ticket during step 970. Thereafter, ticket numbers are assigned during step 975 for each conditional game played, before the ticket number, numbers selected, game type and activation conditions are stored in the appropriate new record in the conditional ticket database 600 during step 980. The ticket data is then transmitted to the lottery terminal 300 during step 985, together with confirmation of any activation conditions, before program control ends during step 990.

Figure 10:
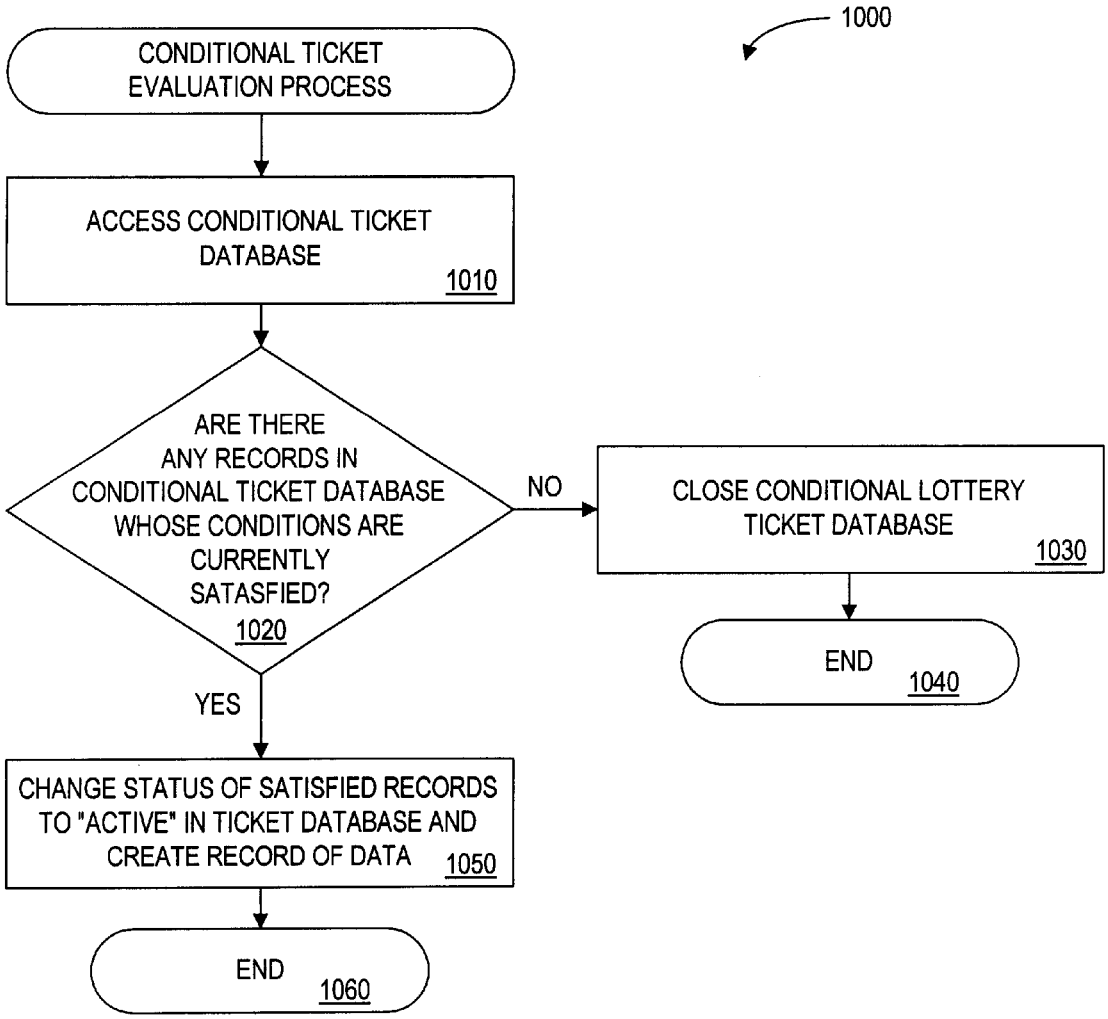
FIG. 10 is a flow chart describing an exemplary conditional ticket evaluation process as implemented by the lottery server of FIG. 4.

As previously indicated, the central lottery server 400 preferably periodically executes the conditional ticket evaluation process 1000, shown in FIG. 10, to evaluate pending conditional lottery tickets to determine if the associated player-specified activation conditions are satisfied and thereby activate the conditional ticket. As illustrated in FIG. 10, the conditional ticket evaluation process 1000 begins the processes embodying the principles of the present invention during step 1010, by accessing the conditional ticket database 600. A test is then performed during step 1020 to determine if there are any records in the conditional ticket database 600 having activation conditions that are currently satisfied. If it is determined during step 1020 that there are no records in the conditional ticket database 600 having activation conditions which are currently satisfied, then the conditional ticket database 600 is closed during step 1030 before program control terminates during step 1040.

If, however, it is determined during step 1020 that there are records in the conditional ticket database 600 having activation conditions which are currently satisfied, then the ticket is activated during step 1050 by changing the status of the satisfied records in the conditional ticket database 600 to "active" and creating a record of the data in the ticket database 500. For example, if the jackpot prize exceeds five million dollars ($5,000,000) at the time the conditional ticket evaluation process 1000 is executed, then ticket number 45683 (FIG. 6) will be activated, and a ticket record is created in the active ticket database 500. Thereafter, program control terminates during step 1060.

Figure 11:
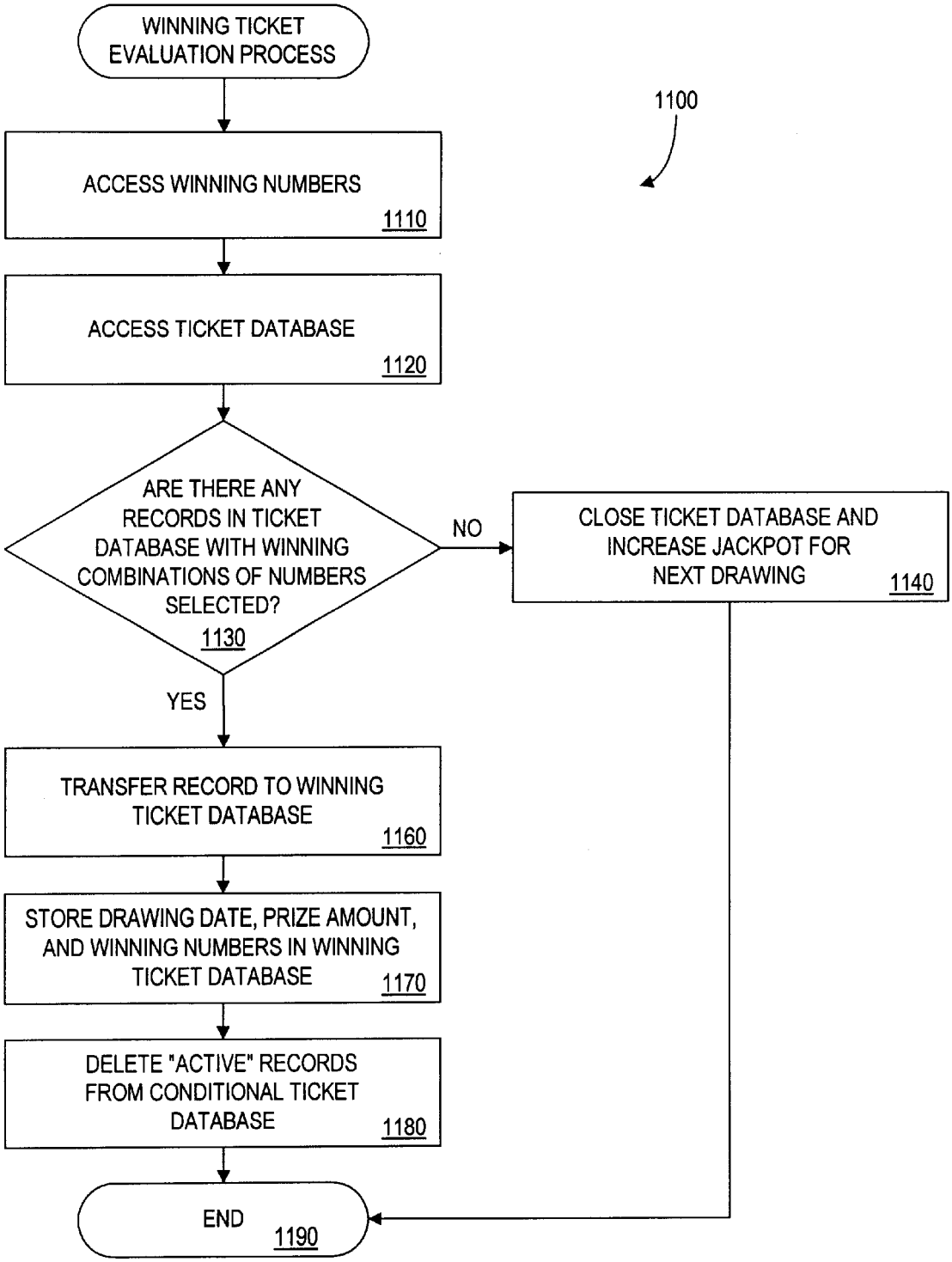
FIG. 11 is a flow chart describing an exemplary winning ticket evaluation process as implemented by the lottery server of FIG. 4.

The central lottery server 400 preferably executes a winning ticket evaluation process 1100, shown in FIG. 11, to identify winning tickets and associated prize amounts. As illustrated in FIG. 11, the winning ticket evaluation process 1100 initially accesses the set of winning numbers during step 1110 and the ticket database 500 during step 1120. A test is then performed during step 1130 to determine if there are any records in the ticket database 500 with winning combinations of numbers selected. If it is determined during step 1130 that there no records in the ticket database 500 with winning combinations of numbers selected, then the ticket database 500 is closed during step 1140 and the jackpot is preferably increased for the next drawing, before program control terminates during step 1190.

If, however, it is determined during step 1130 that there are records in the ticket database 500 with winning combinations of numbers selected, then records having such winning combinations are preferably transferred to the winning ticket database 700 during step 1160. The drawing date, prize amount and winning numbers are preferably stored in each new record of the winning ticket database 700 during step 1170. Thereafter, the, "active" records from the conditional ticket database 600 are preferably deleted during step 1180 before program control terminates during step 1190.

It is to be understood that the embodiments and variations shown and described herein are merely illustrative of the principles of this invention and that various modifications may be implemented by those skilled in the art without departing from the scope and spirit of the invention.

We claim:

1. An apparatus for conducting a lottery drawing, comprising:

means for obtaining a lottery record associated with a sale of a lottery ticket, said lottery record including a lottery selection and a condition precedent to entry of said lottery selection into a lottery drawing, wherein said condition precedent includes a minimum lottery drawing payout; and means for enabling said lottery selection to participate in said lottery drawing if said condition precedent is met prior to execution of said lottery drawing.

2. A method for entering a lottery selection into a lottery drawing, comprising:

receiving data indicative of a sale of a lottery ticket, said data including a lottery selection and a condition precedent to entry of said lottery selection into a lottery drawing, wherein said condition precedent includes a minimum lottery drawing payout; and entering said lottery selection into said lottery drawing if said condition precedent is met.

3. The method of claim 2, further comprising:

determining if said condition precedent has been met.

4. An apparatus for generating a conditional lottery ticket, comprising:

means for obtaining a lottery selection and a condition precedent to entry of said lottery selection into a lottery drawing, wherein said condition precedent includes a minimum lottery drawing payout; and means for generating a lottery ticket indicating said lottery selection and said condition precedent and entitling a player to be entered into said lottery drawing if said condition precedent is met.

5. A method of generating a conditional lottery ticket, said method comprising:

receiving data indicative of a lottery selection and a condition precedent to entry of said lottery selection into a lottery drawing, wherein said condition precedent includes a minimum lottery drawing payout;

receiving data indicative of a validation of said lottery selection and said condition precedent from a lottery server; and generating data indicative of a lottery ticket indicating said lottery selection and said condition precedent and entitling a player to b e entered into said lottery drawing if said condition precedent is met.

6. An apparatus for providing a conditional lottery ticket, comprising:

means for establishing a lottery selection and a condition precedent to an entry of said lottery selection into a lottery drawing, wherein said condition precedent includes a minimum lottery drawing payout; and means for providing a lottery ticket indicating said lottery selection and said condition precedent and entitling entry into said lottery drawing if said condition precedent is met.

7. An apparatus for selectively entering a lottery selection into a lottery drawing, comprising:

means for obtaining a lottery record associated with a sale of a lottery ticket, said lottery record including a lottery selection, a condition precedent to entry of said lottery selection into a lottery drawing and a side-bet related to said lottery drawing; and means for enabling said lottery selection to participate in said lottery drawing if said condition precedent is met.

8. A method for selectively entering a lottery selection into a lottery drawing, comprising:

receiving data indicative of a sale of a lottery ticket, said data including a lottery selection, a condition precedent to entry of said lottery selection into a lottery drawing and a side-bet related to said lottery drawing; and entering said lottery selection into said lottery drawing if said condition precedent is met.

9. An apparatus for conducting a lottery drawing, comprising:

means for obtaining a lottery record associated with a sale of a lottery ticket, said lottery record including a lottery selection, a condition precedent to entry of said lottery selection into a lottery drawing, and a side-bet related to said lottery drawing; and means for enabling said lottery selection to participate in said lottery drawing if said condition precedent is met.

10. An apparatus for creating a conditional lottery ticket, comprising:

means for obtaining a lottery selection, a condition precedent to entry of said lottery selection into a lottery drawing, and a side-bet related to said lottery drawing;

means for sending said lottery selection and said condition precedent to a lottery server; and means for creating a lottery ticket indicating said lottery selection, said condition precedent, and said side-bet, said lottery ticket entitling a player to be entered into said lottery drawing if said condition precedent is met.

11. An apparatus for creating a conditional lottery ticket, comprising:

means for sending a lottery selection, said lottery selection having an associated condition precedent to entry of said lottery selection into a lottery drawing and said lottery selection having an associated side-bet; and means for creating a lottery ticket indicating said lottery selection, said condition precedent and said side-bet, said lottery ticket entitling entry into said lottery drawing if said condition precedent is met.

12. A method for entering a lottery selection into a lottery drawing, comprising:

receiving data indicative of a lottery selection and a customer defined activation condition for entry of said lottery selection into a lottery drawing, wherein said condition precedent includes a minimum lottery drawing payout; and activating said lottery selection if said customer defined activation condition occurs prior to said lottery drawing.

13. The method of claim 12, further comprising associating said lottery selection with a subscription period.

14. The method of claim 13, wherein said lottery selection will only be activated during said subscription period.

15. A method for entering a lottery selection into a lottery drawing, comprising:

receiving data indicative of a lottery selection, a customer defined activation condition to entry of said lottery selection into a lottery drawing and a side-bet related to said lottery drawing; and activating said lottery selection if said customer defined activation condition occurs prior to said lottery drawing.

16. A method for conducting a lottery drawing, comprising:

storing at least one lottery selection for a lottery drawing;

storing at least one activation condition for each of said at least one lottery selection; and activating at least one lottery selection for each of said at least one stored activation condition that is satisfied prior to said lottery drawing.

17. The method of claim 16, further comprising:

determining, prior to said lottery drawing, if any of said stored at least one activation condition is satisfied.

18. The method of claim 16, further comprising:

validating said at least one lottery selection.

19. The method of claim 16, further comprising:

associating a side-bet with said lottery selection.

20. The method of claim 16, further comprising:

associating said at least one lottery selection with a subscription period.

21. The method of claim 20, wherein said at least one lottery selection will only be activated during said subscription period.

22. The method of claim 16, further comprising:

providing a confirmation of a satisfaction of said at least one stored activation condition.

23. A method for conducting a lottery drawing, comprising:

issuing a lottery ticket, said lottery ticket having an associated activation condition;

evaluating if said activation condition is satisfied prior to a lottery drawing; and activating said lottery ticket for said lottery drawing if said activation condition is satisfied prior to said lottery drawing.

24. The method of claim 23, wherein said lottery ticket having an associated side-bet.

25. The method of claim 23, wherein said lottery ticket can be activated a pre-determined number of times.

26. The method of claim 23, further comprising associating said lottery ticket with a subscription period.

27. The method of claim 26, wherein said lottery ticket will only be activated during said subscription period.

28. The method of claim 23, further comprising:

providing a confirmation of a satisfaction of said activation condition.

* * * * *

UNITED STATES PATENT AND TRADEMARK OFFICE

CERTIFICATE OF CORRECTION

PATENT NO. : 6,325,716 B1 
DATED : December 4, 2001
INVENTOR(S) : Jay S. Walker and Thomas M. Sparico It is certified that error appears in the above-identified patent and that said Letters Patent is hereby corrected as shown below:

Title page,
Item [22], please replace "Filed: July 27, 2000" by inserting -- Filed: July 26, 2000 --

Signed and Sealed this

Ninth Day of September, 2003

JAMES E. ROGAN
*Director of the United States Patent and Trademark Office*